US005090291A

United States Patent [19]

Schwartz

[11] Patent Number: 5,090,291

[45] Date of Patent: Feb. 25, 1992

[54] MUSIC SIGNAL TIME REVERSE EFFECT APPARATUS

[76] Inventor: Louis A. Schwartz, 24 Hillside Ave., Ansonia, Conn. 06401

[21] Appl. No.: 516,154

[22] Filed: Apr. 30, 1990

[51] Int. Cl.[5] ..... G10H 1/57; G10H 7/00

[52] U.S. Cl. ..... 84/603; 84/627

[58] Field of Search ..... 84/600, 603, 627, 663, 84/702, 703, 738

[56] References Cited

U.S. PATENT DOCUMENTS 4,003,285 1/1977 Schwartz ..... 84/703

4,160,402 7/1979 Schwartz ..... 84/703 X 4,915,001 4/1990 Dillard ..... 84/600

*Primary Examiner*—Stanley J. Witkowski

[57] ABSTRACT

Apparatus for converting an input note signal of the type having a rapid rise and a slow exponential decay into an output note signal which, from the shape of its envelope, appears to be a time reversed version of the input note signal includes a device which forms a normalized envelope signal, En, and a gain modification device which modifies the instantaneous gain applied to the note signal as a function of the instantaneous amplitude of En. Ideally, the function is proportional to the inverse of the square of the instantaneous amplitude of the normalized envelope signal, En. The gain modification device in accordance with a first embodiment includes an analog-to-digital converter fed by En which addresses a ROM lookup table containing data words corresponding to gain amplitudes. In a second embodiment of the gain modification device, the dynamic range of En is divided into regions and current sources are selected for charging a capacitor depending on in which region the instantaneous amplitude of En lies, to select in each region a slope versus time of the instantaneous gain.

8 Claims, 3 Drawing Sheets

MUSIC SIGNAL TIME REVERSE EFFECT APPARATUS

BACKGROUND OF THE INVENTION

1. Field of the Invention

The present invention relates generally to apparatus for producing unusual audio effects. In its particular aspects, the present invention relates to a device for modulating a music signal to produce, in "real time", an apparent time reversal during each note.

2. Description of the Prior Art

A music note or tone produced by a musical instrument of string, piano or percussion types, and in particular, electric/electronic guitars, is characterized by an envelope having, in time, a relatively rapid rise and a relatively slow, usually exponential, fall or decay. If an isolated music note of the aforementioned type is recorded, as with a tape recorder, and then played backwards, an unusual effect is evident in which the note has a relatively slow rise time and a relatively rapid fall time. Of course, merely playing prerecorded music backwards, in addition to producing an apparent time reversal effect during each note, also causes the sequence of notes to be reversed in order.

In my prior U.S. Pat. Nos. 4,003,285 and 4,160,402 granted respectively Jan. 18, 1977 and July 10, 1979, I disclosed apparatus for providing an effect in the general nature of an apparent time reversal during each note while the order of notes was not disturbed. However, the output note signal produced by the disclosed apparatus differed significantly in both duration and envelope shape from a true time reversed version of the input note signal.

SUMMARY OF THE INVENTION

It is an object of the present invention to provide music signal converter apparatus for producing an output signal, which for each note signal, is a substantially faithful time reversed version of the input note signal, particularly with regard to envelope shape and duration.

Briefly, the aforementioned and other objects of the invention are satisfied by providing normalized envelope forming means, fed by the input port for the input music signal, for, in response to each input note signal of the input music signal, forming a normalized envelope signal having substantially the same rise and fall time characteristics as the envelope of the input note signal, but having an instantaneous amplitude which lies in a predetermined amplitude dynamic range. This is accomplished by, during a preparation period at the beginning of the normalized envelope signal, automatically adjusting the gain between the input port and the output of the normalized envelope forming means to force the maximum amplitude of the normalized envelope signal to a predetermined amplitude.

A further feature of the invention is the provision of note signal gain modification means, fed by the envelope forming means, for, as a function of the instantaneous amplitude of the normalized envelope signal, modifying the instantaneous gain between the input port and the output port in a manner that from the envelope of the output note signal, it will appear as if the input note signal were time reversed. Because only the amplitude of the normalized envelope signal is used in determining the instantaneous note signal gain, the output note signal will have substantially the same duration as the input note signal.

In order to determine the required instantaneous note signal gain from the instantaneous amplitude of the normalized envelope signal, the amplitude dynamic range of the normalized envelope signal is divided into contiguous regions, and gain profile samples stored or otherwise inherent in the note signal gain modification means are selected based on in which region the instantaneous amplitude of the normalized envelope signal lies. These region-dependent gain profile samples may be either gain amplitude samples or samples indicative of the slope of the gain versus time. The contiguous regions may be established by quantizing the normalized note signal with an analog-to-digital converter and utilizing the digital signal produced to address a ROM based lookup table for instantaneous gain amplitudes. Alternatively, an array of comparators for simultaneously comparing the normalized envelope signal with a plurality of amplitude references, which establish the boundaries between regions, may serve to select a region-dependent slope by selecting current sources for charging a capacitor.

The note signal gain modification means is fed from the input port via a delay means for delaying each input note signal relative to the corresponding normalized envelope signal by at least an expected duration of the preparation period.

BRIEF DESCRIPTION OF THE DRAWING

Other objects, features and advantages of the present invention will become apparent upon perusal of the following detailed description of the preferred embodiments when taken in conjunction with the appended drawing, wherein.

DETAILED DESCRIPTION OF THE PREFERRED EMBODIMENTS

Figure 3A:
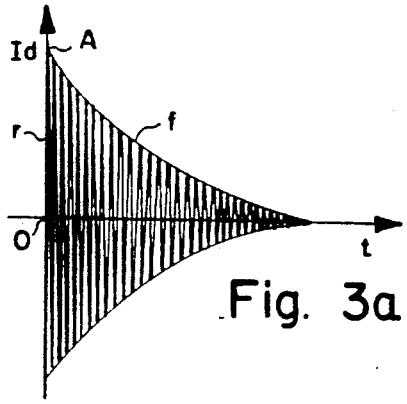
FIGS. 3*a* through 3*e* are a series of aligned graphs versus time of various signals labelled in FIG. 1.
Figure 3B:
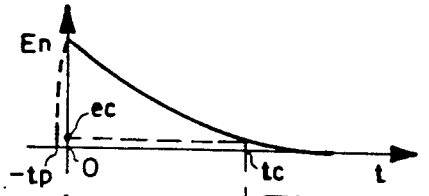
Figure 3C:
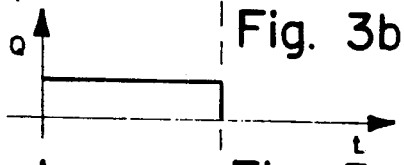
Figure 3D:
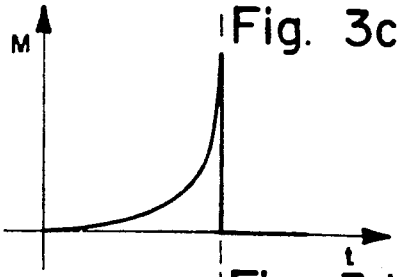
Figure 3E:
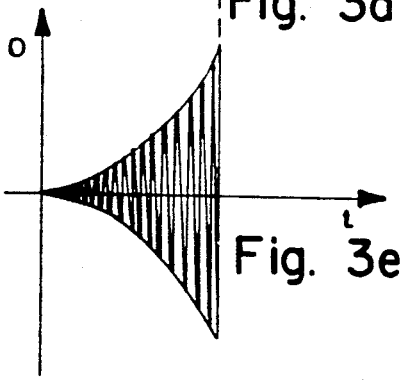

The music signal time reverse effect apparatus of the present invention, will be best understood by first referring to the various aligned graphs of signals versus time, t, in FIGS. 3*a*–3*e*. FIG. 3*a* illustrates a note signal as may be produced by a string, piano or percussion type instrument, and in particular from a pickup on an electric guitar; the note signal is seen to be characterized by a tonal content envelope having a relatively rapid initial rise r to an initial amplitude A and a relatively slow exponential fall f, with a fall time constant T. The note signal illustrated in FIG. 3*a* is indicated by the reference Id to indicate that it is a version of an input note signal I which is delayed by a relatively short preparation period tp indicated in FIG. 3*b*, for reasons which will be explained later. In actuality, sequences of note signals are produced by playing such an instrument, which note signals vary not only in tonal content but in the amplitude A and fall time constant T. In order to define a time reversed note signal having substantially the same duration as the input note signal, the latter is considered to have zero amplitude after time tc, when it has decayed a predetermined not necessarily integer number of time constants tc/T, for example 3.0, to an amplitude ec. By multiplying the delayed input note signal Id having an envelope of the form:

$$Id = A^{*}\exp(-t/T) \quad 0 <= t$$

by the function M illustrated in FIG. 3*d* which is of form:

$$M = \exp(-tc/T)^{*}\exp(2^{*}t/T) \quad 0 <= t <= tc$$
$$M = 0 \quad tc < t$$

there results the apparent time reversed output note signal 0 illustrated in FIG. 3*e* having an envelope of the form:

$$O = A^{*}\exp(-tc/T)^{*}\exp(t/T) = A^{*}\exp((t - tc)/T) \quad 0 <= t <= tc$$
$$O = 0 \quad tc < t$$

If a normalized version En of the input signal is formed as generally illustrated in FIG. 3*b*, then by substituting:

$$ec = \exp(-tc/T) \text{ and } En = \exp(-t/T)$$

the required function M can be expressed in the form:

$$M = ec/En \quad 2 \quad 1 >= En >= ec$$
$$M = 0 \quad ec > En$$

This expression indicates that division of the instantaneous delayed input note signal by the square of the instantaneous amplitude of the normalized envelope, when this instantaneous amplitude is greater than a predetermined minimum, produces, within a constant gain factor, the desired apparently reversed output note signal.

Figure 1:
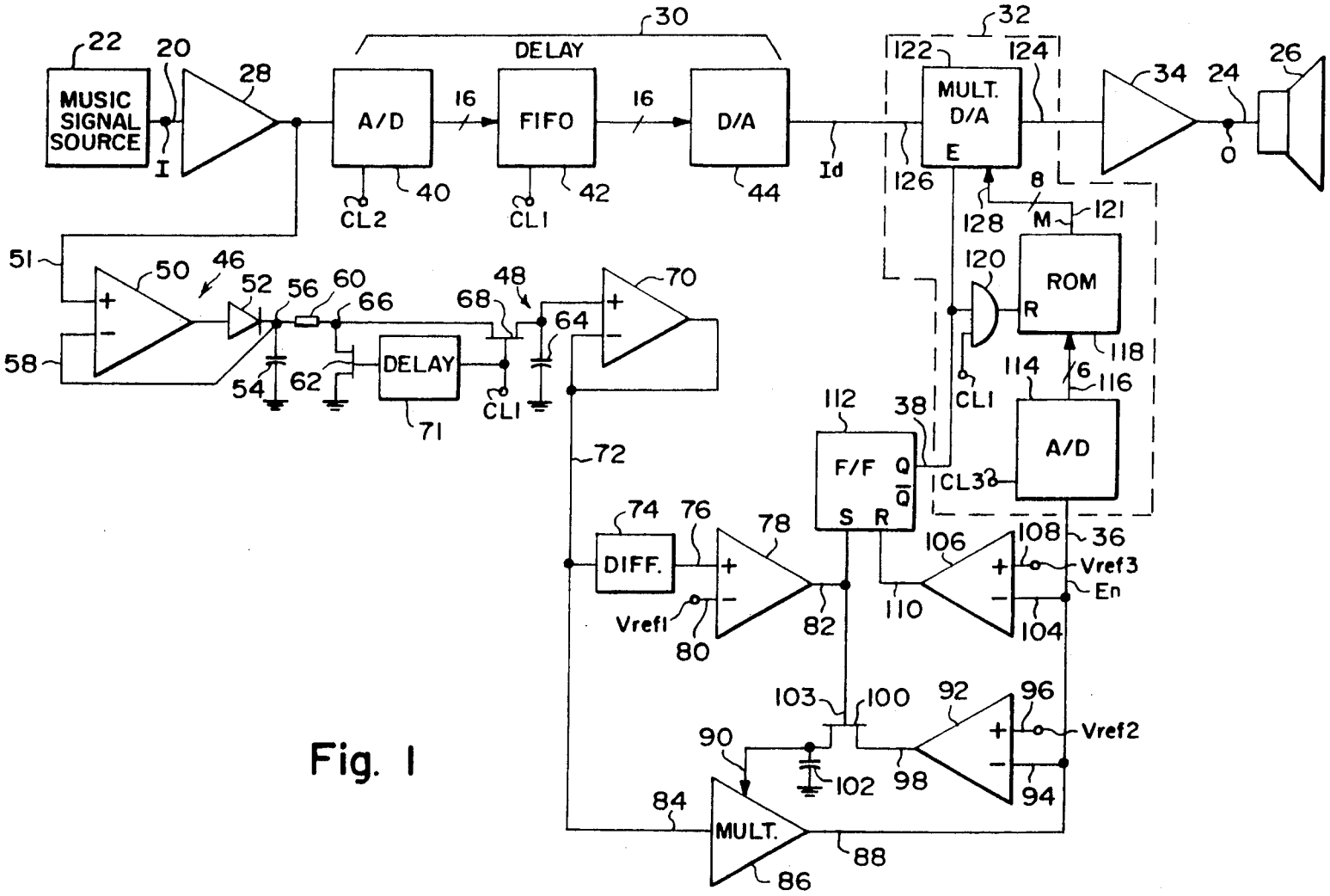
FIG. 1 is a schematic block diagram of the music signal converter apparatus of the present invention including in a dashed box a note signal gain modification means in accordance with a first preferred embodiment.

With this background, the principles underlying the first preferred embodiment of the present invention will become apparent upon a review of FIG. 1 of the drawing. Therein, the music signal time reverse effect apparatus of the present invention comprises an input port 20 for receiving an input music signal, composed of the sequential note signals I, from a music signal source 22 of the type previously identified, such as an electric guitar, and an output port 24 for supplying an apparently time reversed output note signal, corresponding to each input note signal, to an audio device, e.g. an amplified speaker system 26. The input port feeds a buffer amplifier 28 whose output feeds in cascade, a delay means 30, a note signal gain modifying means 32, and a power amplifier 34 feeding output port 24.

In another signal path from the output of buffer 28 to control inputs 36,38 of gain modifying means 32, there are formed respectively the normalized envelope signal En and a logic note existence signal Q indicating when 1>=En>=ec, its complement −Q also being available. As will become more clear as the description proceeds, there is a necessary preparation period tp in the formation of En which is in practice up to 10 milliseconds and the delay means 30 is provided to delay the input note signal by at least that preparation time. In particular, in order to produce at the output of delay means 30 a delayed input note signal Id, which is delayed on the order of 10 milliseconds, delay means 30 comprises in cascade, an analog-to-digital converter 40, a fifo 42, and a digital-to-analog converter 44. For adequate fidelity the digital data paths are 16 bits wide and the sample rate clock CLl applied to fifo 42 is about 40 khz, requiring the application of at least a 640 khz clock CL2 to analog-to digital-converter 40. This requires the fifo to hold at least 400 samples.

The formation of the normalized envelope is accomplished by first detecting the envelope of the input note signal I in an envelope detector comprising a resettable peak detector 46 and a sample and hold 48. Resettable peak detector 46 comprises an operational amplifier (opamp) 50 whose non-inverting input 51 is connected to the output of buffer 28 and whose output feeds, via a diode 52, a capacitor 54 to ground; the junction 56 of diode 52 and capacitor 54 is connected to the inverting input 58 of opamp 50. Capacitor 54 is dischargeable via a small current limiting resistor 60 and a FET switch 62 to ground. Sample and hold 48 comprises a capacitor 64 to ground which is connected to the junction 66 of the small resistor 60 and FET switch 62 via a FET switch 68 and is connected to an opamp 70 configured as a follower. The gate of FET switch 68 is controlled by the sample clock CL1 while the gate of FET switch 62 is controlled by CL1 via a delay 71 of a fraction of the time between samples. Delay 71 enables FET switch 68 to be returned to a nonconductive state before FET switch 62 is placed in a conductive state in order to prevent discharge of capacitor 64 through FET switch 62. It should now be apparent that a repetitive process occurs in which capacitor 54, after having been discharged, charges in voltage to the positive peak of the signal at input 51 within the latter part of a CL1 sample period. Capacitor 64 is then brought to this voltage in response to the CL1 signal at the gate of FET 68 and then capacitor 54 is discharged in response to the delayed CL1 signal at the gate of FET 62. There results at the output 72 of opamp 70 a rather faithful stepwise approximation of the envelope of the input note signal delayed by less than two periods of sample clock CL1.

The detected envelope signal on output 72 is fed to a new note detector means comprising a differentiator 74 whose output is connected to the non-inverting input 76 of an opamp 78 operating open loop as a comparator. The inverting input 80 of opamp 76 is fed from a first voltage reference Vref1 and at the output 82 of opamp comparator 78 is formed a positive pulse during the time at the beginning of a new note envelope when its derivative exceeds a predetermined level corresponding to Vref1; this pulse has a duration which may approach but does not exceed the preparation time period tp afforded by delay means 30.

The detected envelope signal on output 72 is also fed to the input 84 of a transconductance amplifier 86 operating as an analog multiplier for forming at its output 88, the normalized envelope signal En, shown in FIG. 3*b*, as the product of the voltages at its input 84 and a further input 90. The voltage at input 90 corresponds to a gain necessary to normalize the detected envelope signal. This voltage is set during the duration of the pulse at output 82 in a feedback loop which includes an opamp comparator 92 whose inverting input 94 is connected to output 88. The non-inverting input 96 of opamp comparator 92 is connected to a second voltage reference Vref2 and the output 98 of opamp comparator 92 feeds the further input 90 via a FET switch 100.

Further input 90 is also connected to a capacitor 102 to ground. The gate 103 of FET switch 100 is connected to output 82 to receive a positive pulse at the beginning of a new note. It should be now apparent that when FET switch is made conductive by said pulse, the voltage on capacitor 102 will assume a value which will make the amplitude of En at the beginning of a new note equal to Vref2. The value of the voltage set on capacitor 102 at the beginning of a note will remain over the course of that note to set the dynamic range for En.

For developing the note existence signal Q, illustrated in FIG. 3*c*, the normalized envelope signal En on output 88 is also fed to the inverting input 104 of an opamp comparator 106 where it is compared with a third voltage reference Vref3, corresponding to ec, which is applied to non-inverting input 108. There results a positive signal on opamp comparator output 110 when ec>En. Outputs 82 and 110 are respectively connected to the set and reset inputs S,R of a flip-flop 112 which produces the note existence signal Q at the output of the flip-flop having the value logic "1" from the beginning of a new note until En falls below ec.

The note signal gain modification means 32 modifies the gain between input port 20 and output port 24 as a function of the instantaneous amplitude of the normalized envelope signal and of the state of the note existence signal Q. In particular, the dynamic range of En is inherently divided into preferably 64 equal contiguous regions by an analog-to-digital converter 114 having a 6 bit parallel output 116 indicating in which region the instantaneous amplitude of En lies, which analog-to-digital converter samples En at the sample rate determined by clock CL1. In addition to feeding the analog-to-digital converter with En on output 36, a clock signal CL3 is applied of sufficient frequency for the 6 bit conversion to be made within one sample period of sample clock CL1. The digital output provides the address input to a ROM 118 lookup table which in each address stores an 8 bit data word which is proportional to the inverse of the square of the address. The read input R of ROM 118 is connected to the output of an AND gate 120 which has two inputs respectively fed by the note existence signal Q and the Sample clock CL1. During the time a note exists, as indicated by the note existence signal, 8 bit data words are output from ROM 118 on parallel output 121 at the sample rate representing the required instantaneous gain or multiplier signal M, as illustrated in FIG. 3*d* (neglecting quantizing), corresponding to the instantaneous sample amplitude of the normalized envelope signal En. The note signal gain is modified by a multiplying digital-to-analog converter 122, which is in the note signal path intermediate delay means 30 and power amplifier 34, by forming at its analog output 124 the product of the delayed input note signal Id at its analog input 126 and the value represented by the parallel digital signal M at its digital input 128, connected to output 121. Multiplying digital-to-analog converter 122 also receives the note existence signal at its enable input E which forces the analog output at 124 to zero when a note does not exist.

Figure 2:
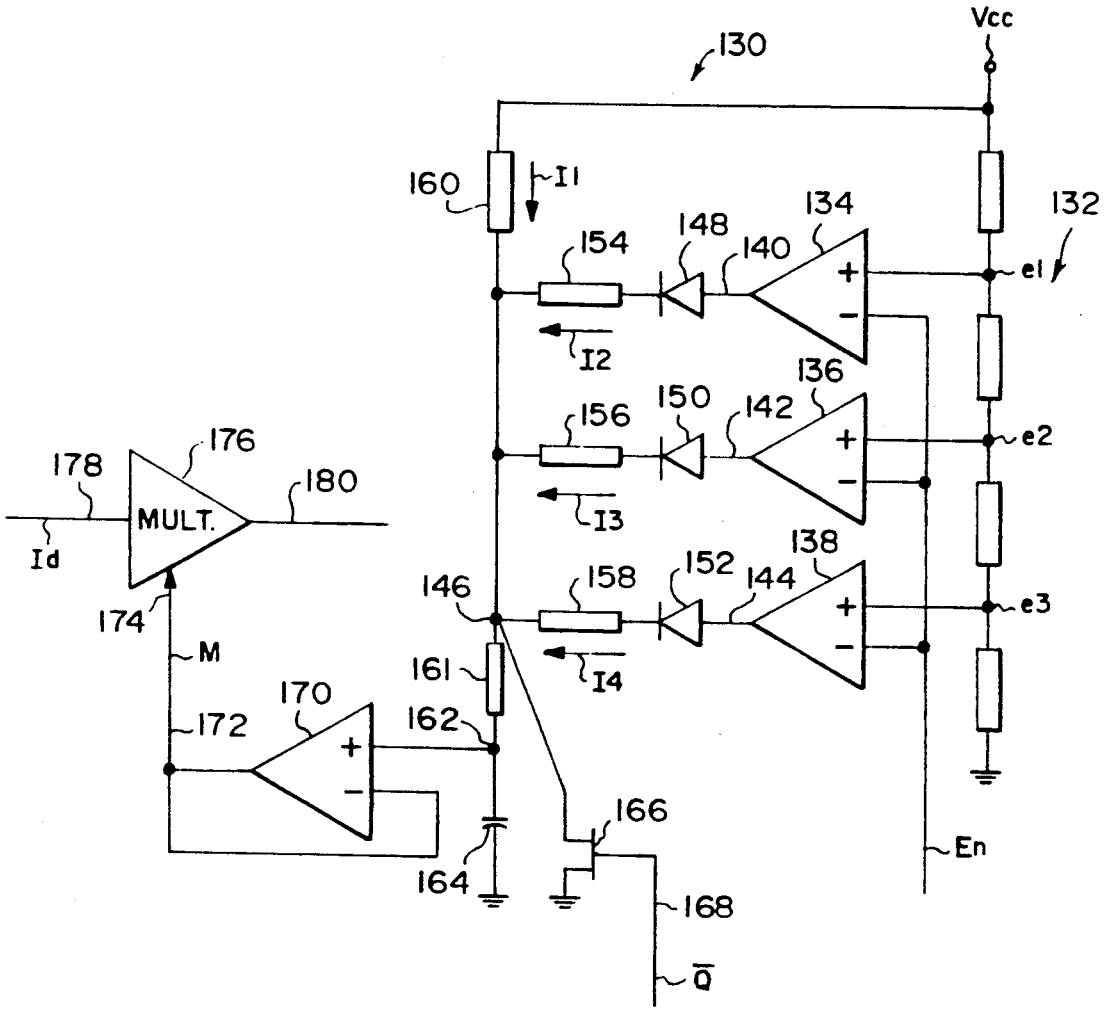
FIG. 2 is a schematic block diagram of an alternate gain modification means in accordance with a second preferred embodiment, for use with the balance of FIG. 1 outside of the dashed box.
Figure 4A:
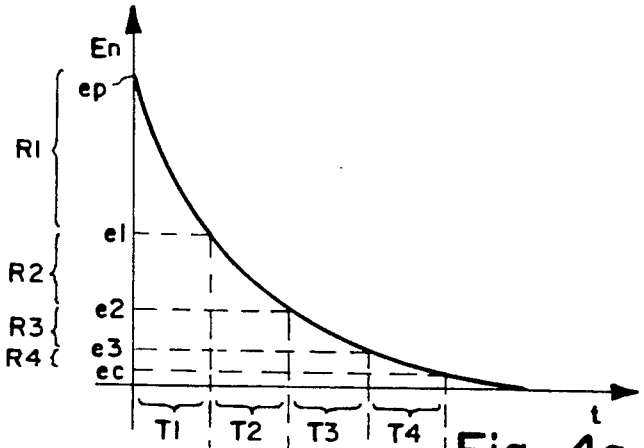
FIGS. 4*a* and 4*b* are aligned graphs versus time of signals labelled in FIG. 2.
Figure 4B:
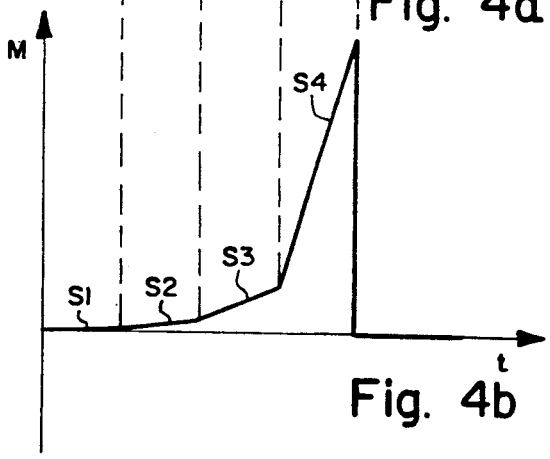

In accordance with a second preferred embodiment of the invention the alternate note signal gain modification means 130 shown in FIG. 2 is utilized. The multiplication signal M produced thereby is illustrated in FIG. 4*b* which is aligned in time with a graph of En illustrated in FIG. 4*a*. In note signal gain modification means 130, the dynamic range of En is divided into a plurality of unequal contiguous regions, such as 4 regions R1–R4 which decrease geometrically in size. These regions are established by a voltage divider 132 across supply voltage Vcc having the taps for the respective reference voltages e1, e2 and e3, which as illustrated in FIG. 4*a*, define the boundaries between the regions R1–R4, R1 beginning at the peak ep of En and R4 ending at ec. Advantageously, e1–e3 are chosen to divide En into 4 equal time regions T1–T4 or phases of En. En is respectively compared with e1, e2 and e3 in opamp comparators 134, 136, and 138 whose respective outputs 140, 142 and 144 are connected to a node 146 via series combinations of diodes 148, 150, and 152, and resistors 154, 156 and 158. Vcc is also connected to node 146 via resistor 160 and a small resistor 161 is connected between node 146 and a node 162. A capacitor 164 is connected between node 162 and ground. For maintaining capacitor 164 discharged except during a note signal, a FET switch 166 to ground is connected to node 146 and the gate 168 thereof is fed by the complement −Q of the note existence signal. Small resistor 161 serves as a current limiting resistor when capacitor 164 is discharged through FET switch 166. Small resistor 161 also, with capacitor 164, establishes the decay time of signal M.

The values of resistors 154, 156, 158, and 160 are chosen sufficiently high that the currents I1, I2 , I3 and I4 which respectively flow therethrough are constant for the time periods in which they flow. I1 flows throughout the existence of a note signal. When En falls below e1, opamp comparator output 140 goes into positive saturation making diode 148 conductive, thereby beginning the flow of I2. Similarly, at the times when En falls respectively below e2 and e3, I3 and I4 respectfully begin flowing. It should now be apparent that the voltage across the capacitor 164 is characterized by the slopes or derivatives S1–S4 in the respective intervals T1–T4, where C is the capacitance of the capacitor, as follows:

$$S1 = C*I1$$
$$S2 = C*(I1 + I2)$$
$$S3 = C*(I1 + I2 + I3)$$
$$S4 = C*(I1 + I2 + I3 + I4)$$

Preferably the relative values of S1, S2, S3 and S4 are selected to be a god piecewise linear approximation of the required multiplier and may be advantageously selected in a geometric progression such as 1,3,9 and 27.

The voltage at node 162 is fed to the input of an opamp 170 in follower configuration to produce at its output 172 the signal M. Output 172 feeds the auxiliary analog input 174 of a transconductance amplifier 176 operating as an analog multiplier. The main input 178 of transconductance amplifier is fed the delayed input note signal Id from delay means 30 (FIG. 1) and its output 180 feeds the power Amplifier 34 (FIG. 1).

The preferred embodiments of the invention have been now been fully described in particular detail. However, it should be understood that numerous modifications in, additions to, or omissions from such details are possible within the intended spirit and scope of the invention.

What is claimed is:

1. Apparatus for converting an input music signal composed of sequential input note signals, each having an envelope with relatively rapid rise time and relatively slow fall time characteristics to an output music signal composed of sequential output note signals corresponding to said input note signals but each having an envelope with relatively slow rise time and relatively rapid fall time characteristics, said apparatus comprising:

an input port adapted to be coupled to a source for said input music signal;

an output port for said output music signal;

a music signal path directed between said input port and said output port, said music signal path having an instantaneous note signal gain defining a ratio of instantaneous amplitudes of said respective note signals of said output and input music signals;

normalized envelope forming means, fed by said input port, for, in response to each input note signal, forming a normalized envelope signal having substantially the same rise and fall time characteristics as the envelope of said each input note signal, but having an instantaneous amplitude which varies within a predetermined amplitude dynamic range composed of a series contiguous amplitude regions; and note signal gain modification means in said music signal path and fed by said normalized envelope forming means, for determining in which amplitude region the instantaneous amplitude of the normalized envelope signal lies and for modifying the instantaneous note signal gain of said music signal path as a function of the the amplitude region determined.

2. The apparatus as claimed in claim 1, wherein said means for determining comprises an analog to digital converter fed by said normalized envelope signal for forming a digital signal indicating in which region the instantaneous amplitude of the normalized envelope signal lies and said means for modifying said instantaneous note signal gain as a function of the amplitude region determined comprises memory means addressed by said digital signal.

3. The apparatus as claimed in claim 1, wherein said means for modifying said note signal gain as a function of the amplitude region determined comprises means for selecting a slope of instantaneous note signal gain versus time as a function of said region.

4. The apparatus as claimed in claim 3, wherein said slope selecting means comprises a capacitor having a voltage indicative of the instantaneous note signal gain, amplitude selectable current source means for charging said capacitor at selectable rates and means for selecting the amplitude of said current source as a function of said region.

5. The apparatus as claimed in claim 1, wherein said normalized envelope forming means comprises envelope detector means fed by said input port for detecting the envelope of said each input note signal, and normalizing means for within a preparation period at the beginning of said each input note signal, setting a gain between the input port and the output of said normalized envelope forming means; said gain modification means comprises a multiplier means having its output and a first input in aid music signal path, and a second input fed by said normalized envelope forming means; and said music signal path further comprises delay means via which said input port feeds said first input of said multiplier means, said delay means having a delay of at least said preparation period.

6. The apparatus as claimed in claim 1, wherein the said function of the instantaneous amplitude of the normalized envelope signal is such that the instantaneous note signal gain is substantially proportional to the inverse of the square of the instantaneous amplitude of the normalized envelope signal, when said instantaneous amplitude of the normalized envelope signal is greater than a predetermined minimum amplitude.

7. Apparatus for converting an input music signal composed of sequential input note signals, each having an envelope with relatively rapid rise time and relatively slow fall time characteristics to an output music signal composed of sequential output note signals corresponding to said input note signals but each having an envelope with relatively slow rise time and relatively rapid fall time characteristics, said apparatus comprising:

an input port adapted to be coupled to a source for said input music signal;

an output port for said output music signal;

a music signal path directed between said input port and said output port, said music signal path having an instantaneous note signal gain defining a ratio of instantaneous amplitudes of said respective note signals of said output and input music signals;

normalized envelope forming means, fed by said input port, for, in response to each input note signal, forming a noramlized envelope signal having substantially the same rise and fall time characteristics as the envelope of said each input note signal, but having an instantaneous amplitude which varies within a predetermined amplitude dynamic range; and note signal gain modification means in said music signal path and fed by said normalized envelope forming means, for modifying the instantaneous note signal gain of said music signal path to be substantially proportional to the inverse of the square of the instantaneous amplitude of the normalized envelope signal, when said instantaneous amplitude of the normalized envelope signal is greater than a predetermined minimum amplitude.

8. The apparatus as claimed in claim 7, wherein said normalized envelope forming means comprises envelope detector means fed by said input port for detecting the envelope of said each input note signal; and normalizing means for within a preparation period at the beginning of said each input note signal, setting a gain between the input port and the output of said normalized envelope forming means; said gain modification means comprises a multiplier means having its output and a first input in said music signal path, and a second input fed by said normalized envelope forming means; and said music signal path further comprises delay means via which said input port feeds said first input of said multiplier means, said delay means having a delay of at least said preparation period.

* * * * *